US011383520B2

(12) United States Patent
Yamada

(10) Patent No.: US 11,383,520 B2
(45) Date of Patent: Jul. 12, 2022

(54) LIQUID EJECTION DEVICE AND LIQUID CONTAINER

(71) Applicant: CANON KABUSHIKI KAISHA, Tokyo (JP)

(72) Inventor: Ryota Yamada, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/167,448

(22) Filed: Feb. 4, 2021

(65) Prior Publication Data

US 2021/0260881 A1 Aug. 26, 2021

(30) Foreign Application Priority Data

Feb. 26, 2020 (JP) ..... JP2020-030487
Nov. 10, 2020 (JP) ..... JP2020-186971

(51) Int. Cl.
*B41J 2/175* (2006.01)

(52) U.S. Cl.
CPC ..... *B41J 2/17513* (2013.01); *B41J 2/17526* (2013.01); *B41J 2002/17516* (2013.01)

(58) Field of Classification Search
CPC .... B41J 2/175; B41J 2/17506; B41J 2/17509; B41J 2/1752; B41J 2/17523; B41J 2/17526; B41J 2/1753; B41J 29/02; B41J 29/13; B41J 2/17513; B41J 2/17556; B41J 2002/17516; B41I 2/17513
See application file for complete search history.

(56) References Cited

U.S. PATENT DOCUMENTS

| | | | | |
|---|---|---|---|---|
| 9,636,918 | B2 * | 5/2017 | Okuno | B41J 29/13 |
| 10,232,627 | B2 | 3/2019 | Toya et al. | B41J 2/1752 |
| 10,500,866 | B2 | 12/2019 | Kawate et al. | B41J 29/13 |
| 2016/0096375 | A1 * | 4/2016 | Ozeki | B41J 2/17513 347/86 |
| 2018/0043694 | A1 | 2/2018 | Toya et al. | B41J 2/17553 |
| 2018/0043695 | A1 | 2/2018 | Kawate et al. | B41J 2/1753 |

FOREIGN PATENT DOCUMENTS

JP 2018-065374 4/2018

* cited by examiner

*Primary Examiner* — Anh T Vo
(74) *Attorney, Agent, or Firm* — Venable LLP

(57) ABSTRACT

In a state where a liquid container is mounted in a liquid ejection device, the position of a handle is maintained at a predetermined position. A device main body that ejections a liquid and a liquid container that contains liquid are provided, the liquid container is attachable to and detachable from the device main body in a direction orthogonal to a width direction, the device main body has a first fitting portion, the liquid container has a handle that rotates around an axis that extends in the width direction, and the handle has a second fitting portion that fits to the first fitting portion.

14 Claims, 12 Drawing Sheets

LIQUID EJECTION DEVICE AND LIQUID CONTAINER

BACKGROUND OF THE INVENTION

Field of the Invention

The present invention relates to a liquid ejection device and a liquid container.

Description of the Related Art

Some of liquid ejection devices such as ink jet printers are configured so that a liquid container that contains a liquid (ink) to be supplied is replaceable from a case and a mounting body including the liquid container is detachably mounted. A liquid container described in Japanese Patent Application Laid-Open No. 2018-65374 includes a flexible bag-shaped member in which liquid is contained and a handle provided for users to carry the liquid container (used during replacement).

SUMMARY OF THE INVENTION

A handle as described in Japanese Patent Application Laid-Open No. 2018-65374 is configured to flexibly move between a position to carry a liquid container and a position to mount the liquid container in a liquid ejection device. In such a configuration, in a case where a mounting body that stores the liquid container is mounted in the liquid ejection device, there is a possibility that the handle may press a flexible bag-shaped member due to the weight of the handle. In this case, there is a concern that the ink supply pressure may change. In addition, due to an impact, a backlash or the like generated during the mounting of the mounting body in the liquid ejection device, a situation where the handle in a free state is at an unexpected position (for example, not at a horizontal position but at an inclined position) can be caused. In this case, when the mounting body is pulled out in the horizontal direction to replace the liquid container due to the consumption of ink, there is a concern that the handle may be caught in the liquid ejection device, which makes it difficult to remove the mounting body. Therefore, the position of the handle in the mounting body mounted in the liquid ejection device is preferably maintained at a predetermined position where the above-described problem is not caused.

An object of the present invention is to provide a liquid ejection device and a liquid container capable of maintaining the position of a handle at a predetermined position in a state where the liquid container is mounted in the liquid ejection device.

A liquid ejection device of the present invention has a device main body that ejections a liquid and a liquid container that contains the liquid, in which the liquid container is attachable to and detachable from the device main body in a direction orthogonal to a width direction of the ink container, the device main body has a first fitting portion, the liquid container has a handle that rotates around an axis that extends in the width direction, and the handle has a second fitting portion that fits to the first fitting portion.

Further features of the present invention will become apparent from the following description of exemplary embodiments with reference to the attached drawings.

DESCRIPTION OF THE EMBODIMENTS

Hereinafter, embodiments of the present invention will be described in detail using drawings. It should be noted that components described in these embodiments are given as examples of the components of the present invention and do not limit the scope of the present invention only to the components.

First Embodiment

Figure 1:
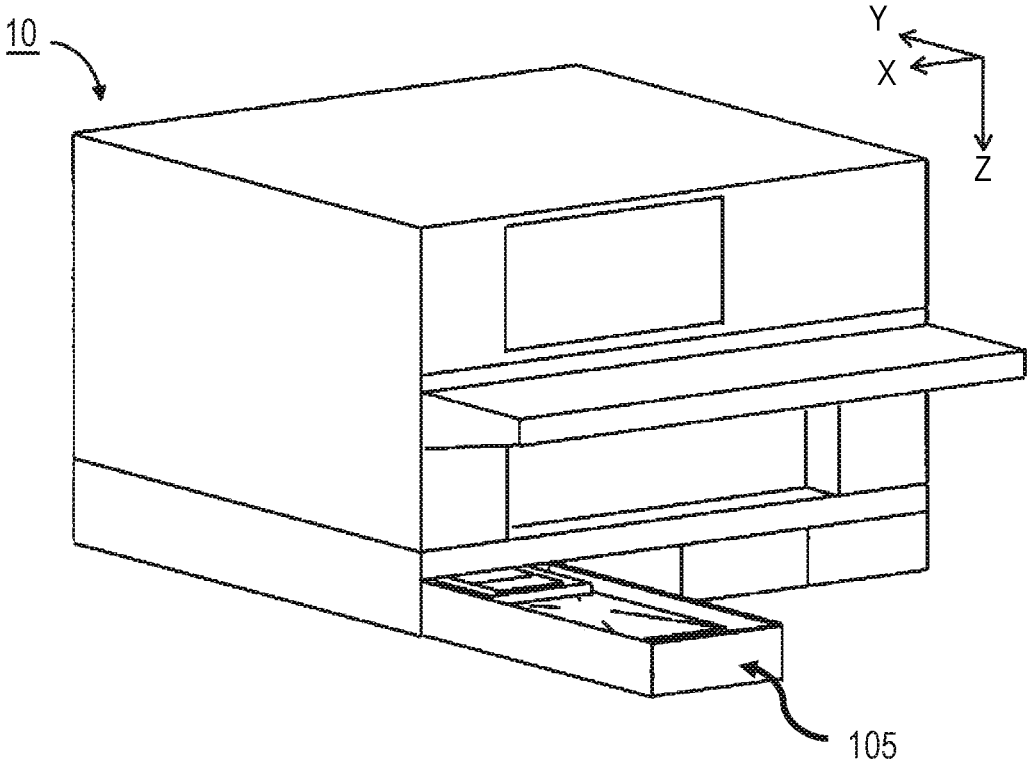
FIG. 1 is a schematic perspective view illustrating an external configuration in a first embodiment of a liquid ejection device of the present invention.

FIG. 1 is a schematic perspective view illustrating the external configuration of a liquid ejection device 10. As illustrated in FIG. 1, a mounting body 105 (the mounting body 105 is configured by storing a liquid container 100 including a bag-shaped member 110 and a connecting member 120 in a case 61, which will be described in detail in FIGS. 2A to 2C) is configured to be attachable to and detachable from the liquid ejection device 10. The liquid ejection device 10 is, for example, an ink jet printer and forms an image by ejecting ink droplets from a recording head (not illustrated) included in the liquid ejection device 10 to record ink dots on a recording medium. Ink may be, for example, a pigment ink containing a coloring component. The recording medium is, for example, printing paper. The liquid container 100 includes the bag-shaped member 110 made of a flexible bag body and the connecting member 120 that connects the bag-shaped member 110 to the liquid ejection device 10 and includes an operating portion that is attached to and detached from the case 61.

The bag-shaped member 110 contains a liquid (ink) that is ejected from the recording head. When the mounting body 105 is mounted in the liquid ejection device 10, the liquid in the bag-shaped member 110 can be supplied to the recording head. In addition, the connecting member 120 includes a liquid withdrawal port 131 and an electrical connecting portion 140 on the front end side and includes a handle 170 that attaches and detaches the bag-shaped member 110 to and from the case 61 on the rear end side. Each configuration will be described in detail below.

It should be noted that, in the drawings used for the following description, as illustrated in FIG. 1, the width direction of the liquid ejection device 10 is defined as an X axis, the depth direction of the liquid ejection device 10 (the attachment and detachment direction of the mounting body 105) is defined as a Y axis, and the height direction of the liquid ejection device 10 is defined as a Z axis.

Figure 2A:
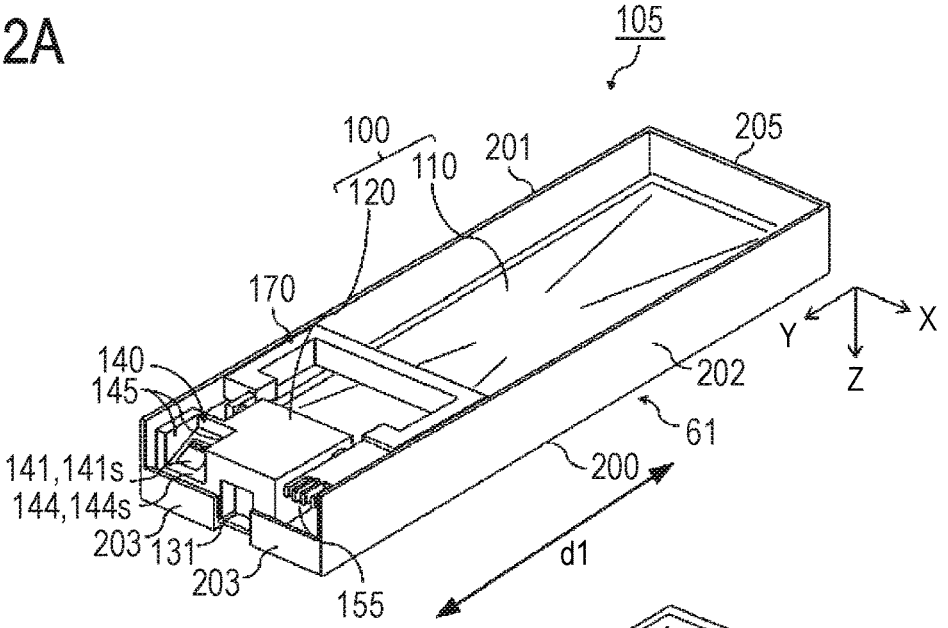
FIGS. 2A, 2B, and 2C are schematic perspective views of a liquid container.
Figure 2B:
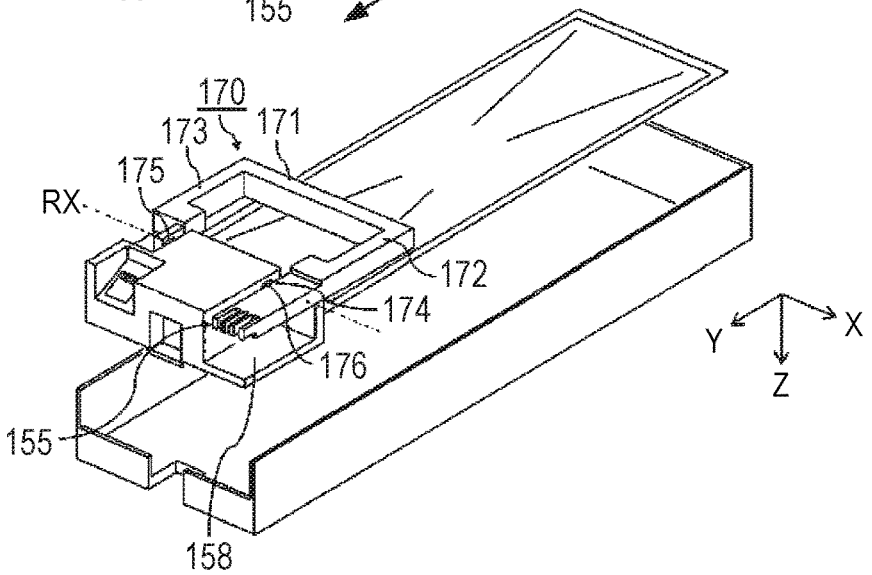
Figure 2C:
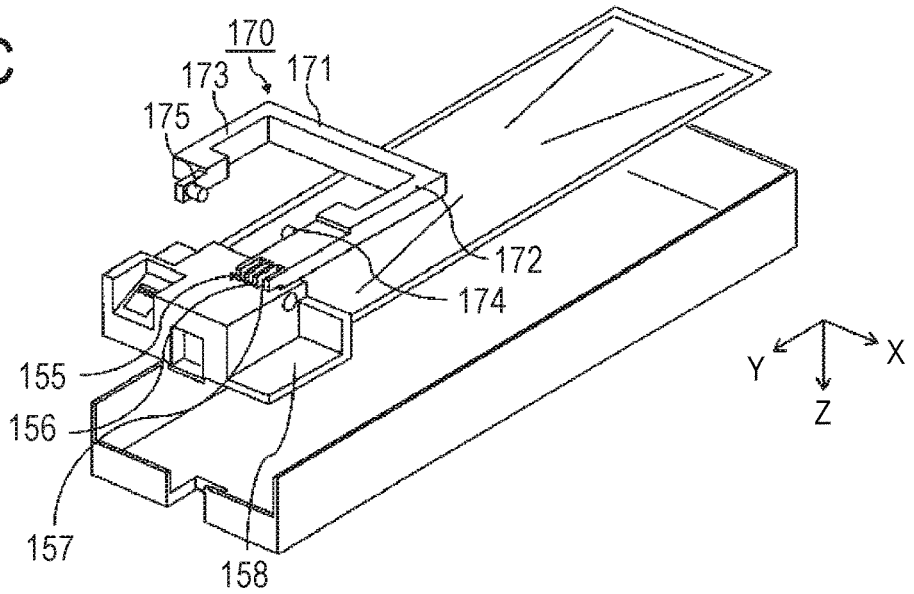

FIGS. 2A to 2C is a schematic perspective view of the mounting body 105 illustrated in FIG. 1. FIG. 2A is a schematic perspective view of the mounting body 105 configured by containing the liquid container 100 including the bag-shaped member 110 and the connecting member 120 in the case 61. In addition, FIG. 2B is a schematic perspective view illustrating the case 61 and the liquid container 100 that are separated from each other, and FIG. 2C is a schematic perspective view illustrating the handle 170 separated from the connecting member 120. The liquid container 100 has a substantially rectangular shape having the longitudinal direction in an attachment and detachment direction dl (the Y direction in FIG. 1 or FIGS. 2A to 2C, which will be referred to as the longitudinal direction below) with respect to the device main body. The connecting member 120 is disposed on the front end side in a mounting direction with respect to the device main body, and the bag-shaped member 110 is disposed on the rear end side. The longitudinal direction is a direction orthogonal to the width direction (the X direction in FIGS. 2A to 2C) of the liquid container 100. The height of the liquid container 100 (the length in the vertical direction (the Z direction) in FIGS. 2A to 2C on the paper) is shorter than the length (the length of the rectangular shape in the longitudinal direction) and the width (the length of the rectangular shape in the transverse direction) of the liquid container 100. The "height", "length" and "width" mean the distances in the respective directions between the outermost portions of the liquid container 100 in the corresponding directions. That is, the liquid container 100 has a thin flat plate shape having a small thickness. Therefore, the liquid container 100 enables the obtainment of high stability regarding the disposition posture on the case 61.

The bag-shaped member 110 configuring the liquid container 100 is a container that contains liquid inside. The bag-shaped member 110 is flexible. The bag-shaped member 110 may be flexible enough to bend due to the weight of the bag-shaped member 110 or may be flexible to an extend that the bag-shaped member 110 holds the shape against the weight, but bends when a load larger than the weight of the bag-shaped member 110 is applied. The bag-shaped member 110 has a substantially rectangular shape having the longitudinal direction in the attachment and detachment direction dl with respect to the device main body. The bag-shaped member 110 is configured by laminating two sheet members and fusing the outer peripheral end portions of the sheet members. The sheet member is formed using a material having flexibility, a gas barrier property and a liquid impermeable property. Each sheet member may be configured using a film member of, for example, polyethylene terephthalate (PET), nylon or polyethylene. Each sheet member may be configured by laminating a plurality of films made of the above-described material. In this case, for example, the outer layer may be formed using a PET or nylon film having excellent impact resistance, and the inner layer may be formed using a polyethylene film having excellent ink resistance. Furthermore, a layer on which aluminum or the like is vapor-deposited may be added to the laminated structure.

As illustrated in FIG. 2A, the connecting member 120 that configures the liquid container 100 is fixed to the end portion of the mounting body 105 on the front end side in the mounting direction. The connecting member 120 has a function of being connected to a connection receiving portion of the corresponding liquid ejection device 10, a function of attaching and detaching the liquid container 100 to and from the case 61, and a function of fixing the liquid container 100. The outline of the appearance of the connecting member 120 will be described. The connecting member 120 typically has a substantially rectangular parallelepiped shape having the longitudinal direction in a direction orthogonal to the longitudinal direction of the liquid container 100 on the horizontal plane (the width direction described above. Hereinafter, the direction will be referred to as the width direction). The width (the length in the width direction) of the connecting member 120 is slightly longer than the width (the length in the width direction) of the bag-shaped member 110. The difference between these widths may be set to, for example, approximately several millimeters to several tens of millimeters. A main body portion of the connecting member 120 is produced by molding, for example, a resin member such as polypropylene.

The connecting member 120 has the liquid withdrawal port 131 and the electrical connecting portion 140. The liquid withdrawal port 131 is an opening portion that opens in a direction in which the liquid container 100 is mounted in the device main body. That is, the central axis of the liquid withdrawal port 131 is parallel to the longitudinal direction. The liquid withdrawal port 131 communicates with a containing portion that is a liquid containing region inside the bag-shaped member 110 through a supply port portion that is attached to the front end portion in the direction in which the liquid container 100 is mounted in the device main body. The liquid withdrawal port 131 is provided at almost the central position in the width direction of the connecting member 120. The liquid withdrawal port 131 is formed at almost the same height position as the bag-shaped member 110 when the bag-shaped member 110 is fixed. The mounting body 105 is mounted in the device main body, whereby a liquid introduction portion in the liquid ejection device 10 is inserted into the liquid withdrawal port 131.

The electrical connecting portion 140 includes a substrate 141 configured to be connected to a device-side electrical connecting portion in the liquid ejection device 10. A plurality of terminals is disposed on a surface of the substrate 141. The plurality of terminals is disposed at positions corresponding to terminals in the device-side electrical connecting portion. On a surface opposite to the surface of the substrate 141, a storage device that stores information regarding the liquid, a circuit for detecting the connection of the device-side electrical connecting portion or the like may be provided. In the present embodiment, the electrical connecting portion 140 is provided at an end portion of the connecting member 120 in the direction in which the liquid container 100 is mounted in the device main body. In addition, the electrical connecting portion 140 is positioned closer to an end side of the connecting member 120 than the liquid withdrawal port 131 in the width direction. In the connecting member 120, a substrate disposition portion 144 configured to dispose the substrate 141 of the electrical connecting portion 140 is formed as a recess portion recessed in the longitudinal direction and in the height direction of the liquid container 100 (hereinafter, referred to as the height direction). In the substrate disposition portion 144, an inclined surface **144*s* that faces in a direction inclined upward between the longitudinal direction and the height direction is formed. The substrate 141 is disposed to be inclined on the inclined surface 144*s* at a disposition angle that is almost parallel to the inclined surface 144*s***. That is, the normal vector of a contact surface of the surface

141*s* of the substrate 141 has a vector component in the longitudinal direction and a vector component in the height direction.

As described above, the substrate 141 is disposed such that the surface 141*s* faces in the height direction. Therefore, when the device-side electrical connecting portion is electrically connected, the electrical connecting portion 140 electrically comes into contact with the device-side electrical connecting portion while receiving at least a force that is directed downward from the device-side electrical connecting portion. Due to this force that is directed downward, the contact state between the electrical connecting portion 140 and the device-side electrical connecting portion becomes favorable, and the electrical connectivity of the electrical connecting portion 140 is enhanced.

In addition, when the liquid container 100 is removed from a case storage portion of the liquid ejection device 10 together with the case 61, due to the force that is received from the device-side electrical connecting portion and is directed downward, the movement of the liquid container 100 from the liquid ejection device 10 in the removal direction is assisted. Therefore, the removal of the liquid container 100 from the liquid ejection device 10 is simplified. The substrate 141 is installed at a deep position in the substrate disposition portion 144. The substrate 141 is sandwiched by two wall portions 145 that protrude in the longitudinal direction and in the height direction from the surface 141*s* of the substrate 141 on both sides in the width direction. These wall portions 145 function as members that protect the substrate 141. Therefore, the substrate 141 can be prevented from being damaged when, for example, a user accidentally touches the substrate 141 or the liquid container 100 accidentally drops.

The case 61 has a substantially rectangular parallelepiped shape having the longitudinal direction in the attachment and detachment direction dl with respect to the device main body. The case 61 is formed as a hollow box body that is open in an upper portion on the horizontal plane. The case 61 is produced using, for example, a resin member of polypropylene or the like. The case 61 includes a bottom surface wall portion 200, two side wall portions 201 and 202, two rear surface wall portions 203, and a front surface wall portion 205. The bottom surface wall portion 200 is a substantially rectangular wall portion that configures the bottom surface portion of the case 61 and extends in the longitudinal direction and in the width direction. In the present specification, the expression "extend" means a configuration that continuously extends in a certain direction without being divided. In the middle of the extension, a protrusion and a recess, a curved portion, a hole portion, and a joined portion may be provided. The liquid container 100 is disposed on the bottom surface wall portion 200. The bottom surface wall portion 200 has a size large enough to accommodate at least the entire bag-shaped member 110 when the liquid container 100 is disposed. The heights of the side wall portions 201 and 202 almost coincide with the height of the connecting member 120 in the liquid container 100. The two rear surface wall portions 203 stand in the height direction at an end portion of the bottom surface wall portion 200 in the longitudinal direction. Each of the rear surface wall portions 203 is provided at either end in the width direction and is coupled to one of the two side wall portions 201 and 202 that is present on the same side in the width direction. In a state where the liquid container 100 is contained in the case 61, the liquid withdrawal port 131 is disposed between the two rear surface wall portions 203. The heights of the two rear surface wall portions 203 are lower than the heights of the side wall portions 201 and 202, respectively. The two rear surface wall portions 203 are formed so as to cover portions lower than the electrical connecting portion 140 of the connecting member 120 and a liquid container-side fitting portion 155, which is a second fitting portion, in a state where the liquid container 100 is contained in the case 61. The front surface wall portion 205 extends in the width direction and in the height direction at an end portion of the bottom surface wall portion 200 in the removal direction of the liquid container 100 from the liquid ejection device 10 and is coupled to the bottom surface wall portion 200 and the two side wall portions 201 and 202.

The handle 170 is a portion that a user grips when moving the liquid container 100 for the attachment to or detachment from the case 61 or the like. In the present embodiment, the handle 170 is produced by molding a resin member of polypropylene or the like. FIG. 2B is a schematic perspective view illustrating the appearance of the liquid container 100 removed from the case 61. As illustrated in FIG. 2B, the handle 170 includes a grip portion 171, two coupling portions 172 and 173, two base end portions 174 and 175, and the liquid container-side fitting portion 155. The grip portion 171 is a portion for the user to put a hand on. The grip portion 171 extends in the width direction. In the present embodiment, the length of the grip portion 171 in the width direction is slightly shorter than the length of the connecting member 120 in the width direction and is slightly longer than the length of the bag-shaped member 110 in the width direction. The two coupling portions 172 and 173 extend in the longitudinal direction from both ends of the grip portion 171. The coupling portion 172 couples one end portion of the grip portion 171 in the width direction and the base end portion 174. The coupling portion 173 couples the other end portion of the grip portion 171 in the width direction and the base end portion 175. The base end portions 174 and 175 are axial portions having a substantially cylindrical shape, respectively, and protrude so as to face each other along the width direction. It is desirable that the grip portion 171 and the coupling portions 172 and 173 are appropriately thinned in order for weight reduction. The base end portion 174 protrudes at an end portion of the coupling portion 172 in a direction toward the inside of the liquid container 100 in the width direction. The base end portion 175 protrudes at an end portion of the coupling portion 173 in a direction toward the inside of the liquid container 100 in the width direction. Each of the two base end portions 174 and 175 is connected to a fixing portion 176 of the connecting member 120. Due to the fixing portion 176, the handle 170 is fixed to the connecting member 120 so as to be capable of rotating around an axis that extends in the width direction. In the present embodiment, the fixing portion 176 is configured using a shaft hole that extends in the width direction, and each of the base end portions 174 and 175 is inserted into the shaft hole in the width direction. The handle 170 is provided at a position where the handle 170 is exposed in a state where the liquid container 100 is contained in the case 61. The handle 170 is provided at a position where the user is able to see and operate the handle 170. The handle 170 rotates with respect to the connecting member 120 according to the user's operation. The handle 170 is capable of rotating in both directions, that is, a direction from the bag-shaped member 110 side toward the connecting member 120 side and a direction from the connecting member 120 toward the bag-shaped member 110. The rotation axis, which is the center of the rotation of the handle 170, coincides with the central axes of the two base end portions 174 and 175. When the handle 170 rotates and the liquid container-side fitting portion 155 hits an abutting surface 158, the rotation is stopped. The handle 170 rotates around the central axes (hereinafter, referred to as the rotation axis RX) of the two base end portions 174 and 175 of the handle 170.

The use of the handle 170 enhances convenience at the time of the handling of the liquid container 100 such as the carrying of the liquid container 100 and the attachment to or detachment from the case 61. Particularly, in the present embodiment, the handle 170 has the grip portion 171 that extends in the width direction, thereby having a shape that the user easily grips. In addition, the handle 170 is fixed to the connecting member 120 at two points of the base end portions 174 and 175 and can be stably rotated. As described above, according to the shape of the handle 170 of the present embodiment, since high operability can be obtained, the ease of handling the liquid container 100 is enhanced.

The liquid container-side fitting portion 155 is provided at an end portion of the handle 170 in the mounting direction of the mounting body 105. FIG. 2C is a schematic perspective view illustrating the appearance of the handle 170 removed from the connecting member 120. As illustrated in FIG. 2C, the liquid container-side fitting portion 155 is provided on an extension line from the coupling portion 172 of the handle 170 and at a position facing the grip portion 171 across the base end portion 174. The liquid container-side fitting portion 155 is provided on a side opposite to the electrical connecting portion 140 across the liquid withdrawal port 131 in the width direction. The liquid container-side fitting portion 155 has a protrusion and recess structure in which a plurality of substantially rectangular second combs 156 that extend in parallel in the mounting direction are arranged. Regarding the arrangement pattern in the width direction of the combs 156 and valley portions 157, which are recessed portions formed between the combs 156, in the liquid container-side fitting portion 155, the protrusions and the recesses are opposite to protrusions and recesses in the arrangement pattern in the protrusion and recess structure of a fitting portion (first fitting portion) inside the liquid ejection device 10 that is a connection target. The liquid ejection device 10 is provided with a plurality of connection receiving portions (slots) for the mounting of the liquid container 100, and the connection receiving portion in which the liquid container 100 is mounted is determined depending on the type (for example, color) of ink that is contained in the liquid container 100. When the liquid container 100 is moved in the mounting direction and is connected to the corresponding liquid ejection device 10, in a case where the combination of the liquid container 100 and the connection receiving portion is appropriate, fitting between the protrusion and recess structure of the fitting portion on the on the liquid ejection device 10 side and the protrusion and recess structure of the liquid container-side fitting portion 155 of the liquid container 100 is allowed. On the other hand, in a case where the combination between the liquid container 100 and the connection receiving portion is not appropriate, the protrusion and recess structure of the fitting portion on the liquid ejection device 10 side does not match the protrusion and recess structure of the liquid container-side fitting portion 155 of the liquid ejection device 10, the liquid container 100 and the connection receiving portion cannot be fitted to each other. Therefore, the connection of an unmatched wrong liquid container 100 to the connection receiving portion is suppressed.

It should be noted that at least a part of the surface of the handle 170 is colored with the color of ink that is contained in the liquid container 100, and furthermore, as the protrusion and recess structure of the liquid container-side fitting portion 155 of the liquid container 100, a structure (shape) that corresponds to the protrusion and recess structure of the fitting portion of the connection receiving portion in which the liquid container 100 for the ink with the above-described color is to be contained is provided. Therefore, the connecting member 120 having a combination of the handle 170 for each color and the liquid container-side fitting portion 155 can be produced, and the number of components can be reduced.

Figure 3A:
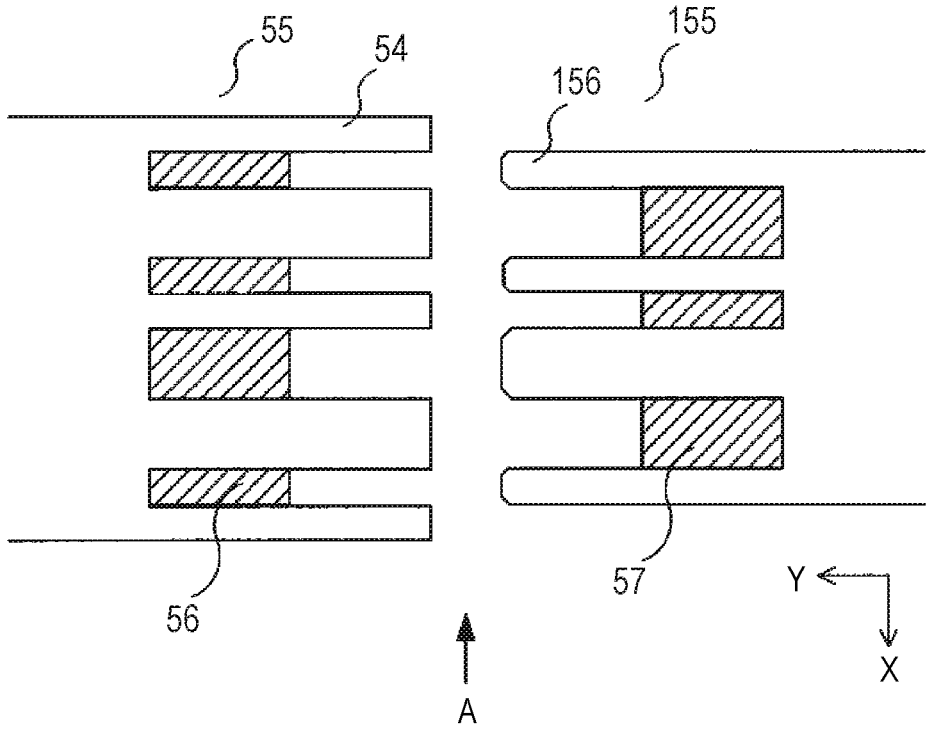
FIGS. 3A, 3B, and 3C are enlarged views illustrating an example of fitting portions in the first embodiment.
Figure 3B:
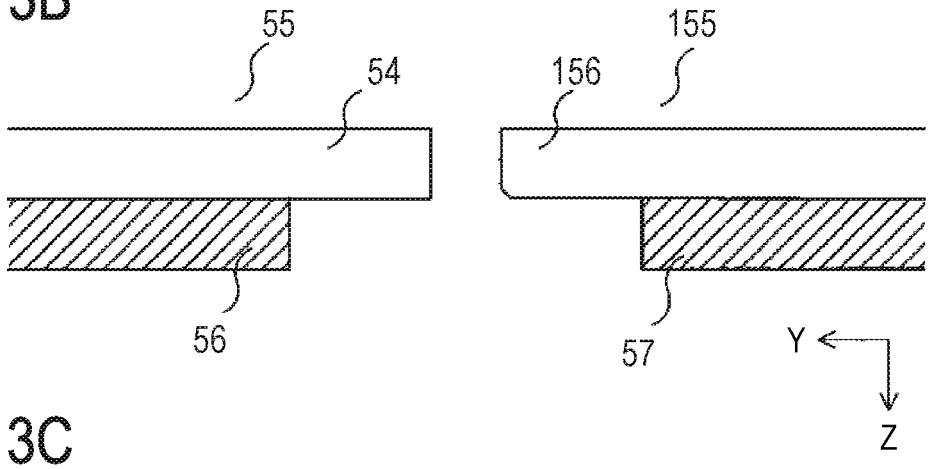
Figure 3C:
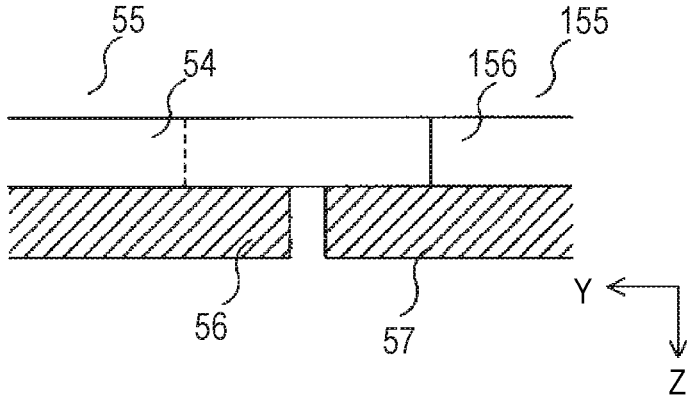

FIGS. 3A to 3C is an enlarged view illustrating an example of a device-side fitting portion 55 inside the liquid ejection device 10 and the liquid container-side fitting portion 155 in the present embodiment. FIG. 3A is a top view, FIG. 3B is a side view of the structure of FIG. 3A seen in a direction A illustrated in FIG. 3A, and FIG. 3C is a side view of the structure of the device-side fitting portion 55 and the liquid container-side fitting portion 155 fitted to each other seen in the direction A illustrated in FIG. 3A. The device-side fitting portion 55, which is the first fitting portion, and the liquid container-side fitting portion 155, which is the second fitting portion, have protrusion and recess structures (complementary structures) in which the arrangement patterns in the width direction are opposite to each other, whereby rattling in the width direction during fitting can be suppressed. As described above, the liquid ejection device 10-side fitting portion 55 has combs 54 that regulate the liquid container 100 that can be mounted in the liquid ejection device 10 main body, and the liquid container-side fitting portion 155 has the combs 156 that regulate the liquid container 100 that can be mounted in the liquid ejection device 10 main body. The combs 54 are first combs in which a plurality of plate materials is arranged in the width direction, and the combs 156 are second combs in which a plurality of plate materials is arranged in the width direction. In addition, the ridge line of each comb 156 of the liquid container-side fitting portion 155 is provided with a tapering shape such that the liquid container 100 stored in the case 61 can be fitted into the liquid ejection device 100 without any resistance at the time of mounting the liquid container 100 in the liquid ejection device 10. The liquid container-side fitting portion 155 is integrated with the handle 170 and rotates around the rotation axis RX in conjunction with the rotation of the handle 170 around the rotation axis RX (refer to FIGS. 5A and 5B). During the fitting of the device-side fitting portion 55 and the liquid container-side fitting portion 155, in order to hinder the rotation of the liquid container-side fitting portion 155 around the rotation axis RX, in the device-side fitting portion 55 and the liquid container-side fitting portion 155, rotation stoppers 56 and 57, which are a first rotation regulating portion and a second rotation regulating portion, are provided, respectively, at the lower portions of the protrusion and recess structures. As illustrated in FIG. 3C, when the liquid container 100 is mounted in the liquid ejection device 10 main body, and the device-side fitting portion 55 and the liquid container-side fitting portion 155 are fitted to each other, the rotation stopper 56 and the combs 156 abut or face each other, which regulates the upward rotation of the handle 170 around the width direction. In addition, when the liquid container 100 is mounted in the liquid ejection device 10 main body, and the device-side fitting portion 55 and the liquid container-side fitting portion 155 are fitted to each other, the rotation stopper 57 and the combs 54 abut or face each other, which regulates the downward rotation of the handle 170 around the width direction. The rotation stopper 56 is a first flat plate that is provided on the lower surfaces of the combs 54 and is retracted inward from the combs 54. The rotation stopper 57 is a second flat plate that is provided on the lower surfaces of the combs 156 and is retracted inward from the combs 156.

Since the position of the handle is regulated by forming the liquid container-side fitting portion 155 in the handle 170 as described above, the configuration of a pressurized state in the bag-shaped member 110 is regulated. In addition, in a case where the mounting body 105 is mounted in the device, the handle is not inclined due to a backlash or the like, and there is not a concern that the handle may be caught in the liquid ejection device, which makes it difficult to remove the mounting body is removed.

Figure 4A:
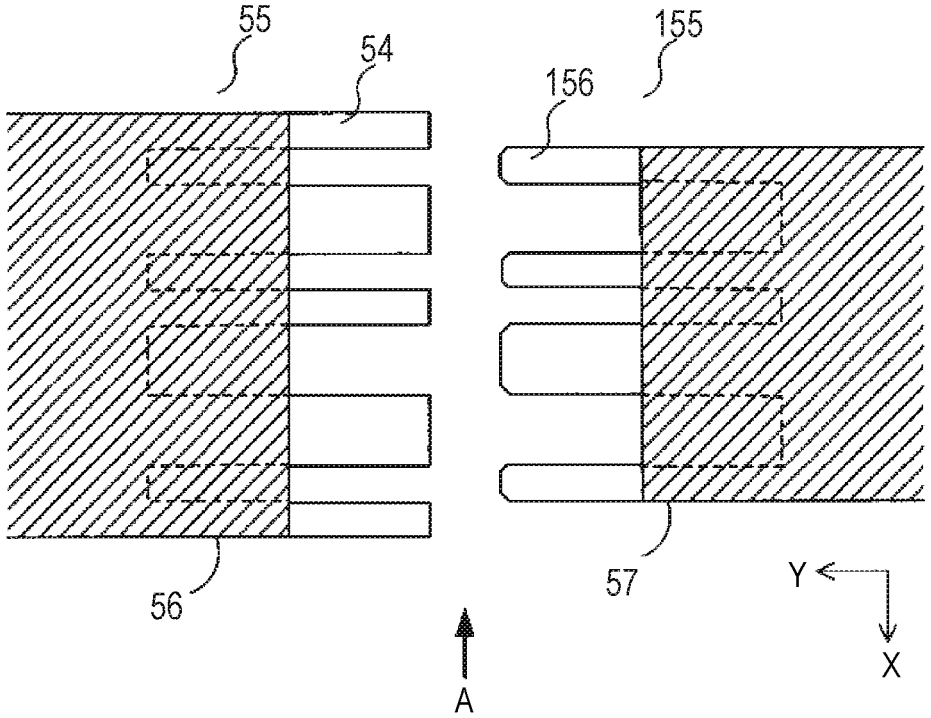
FIGS. 4A, 4B, and 4C are enlarged views illustrating another example of the fitting portions.
Figure 4B:
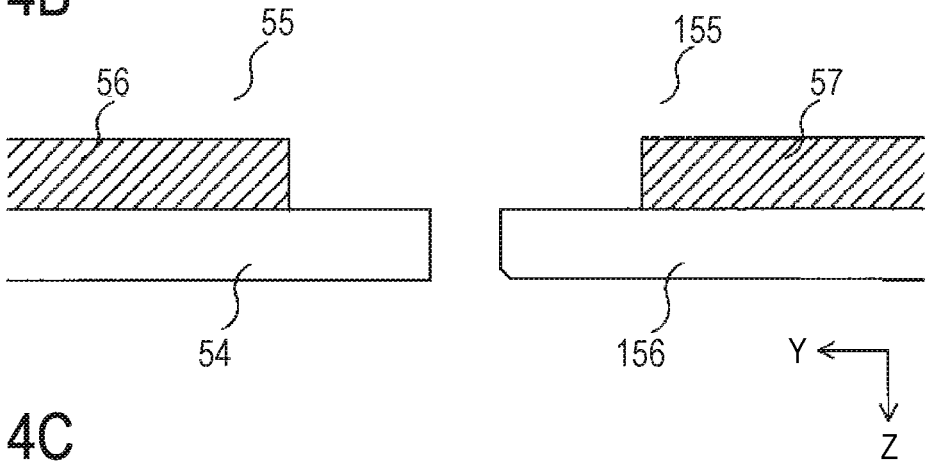
Figure 4C:
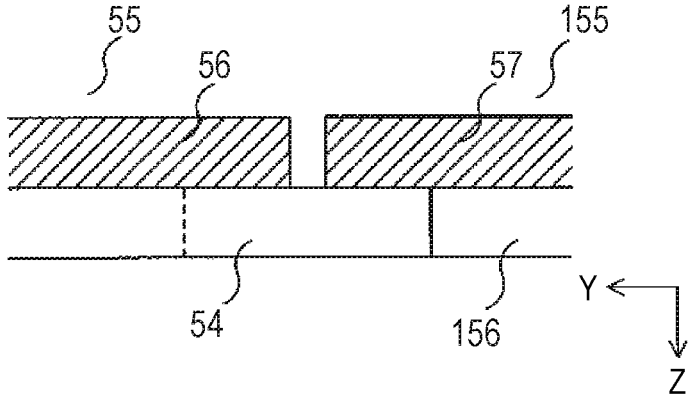

FIGS. 4A to 4C is an enlarged view illustrating another example of the device-side fitting portion 55 inside the liquid ejection device 10 and the liquid container-side fitting portion 155 in the present embodiment. FIG. 4A is a top view, FIG. 4B is a side view of the structure of FIG. 4A seen in a direction A illustrated in FIG. 4A, and FIG. 4C is a side view of the structure of the device-side fitting portion 55 and the liquid container-side fitting portion 155 fitted to each other seen in the direction A illustrated in FIG. 4A. The structures of the combs 54 and the combs 156 are the same as those illustrated in FIGS. 3A to 3C. During the fitting of the device-side fitting portion 55 and the liquid container-side fitting portion 155, in order to hinder the rotation of the liquid container-side fitting portion 155 around the rotation axis RX (refer to FIGS. 5A and 5B), in the device-side fitting portion 55 and the liquid container-side fitting portion 155, the rotation stoppers 56 and 57, which are the first rotation regulating portion and the second rotation regulating portion, are provided, respectively, at the upper portions of the protrusion and recess structures. As illustrated in FIG. 4C, when the liquid container 100 is mounted in the liquid ejection device 10 main body, and the device-side fitting portion 55 and the liquid container-side fitting portion 155 are fitted to each other, the rotation stopper 57 and the combs 54 abut or face each other, which regulates the upward rotation of the handle 170 around the width direction. In addition, when the liquid container 100 is mounted in the liquid ejection device 10 main body, and the device-side fitting portion 55 and the liquid container-side fitting portion 155 are fitted to each other, the rotation stopper 56 and the combs 156 abut or face each other, which regulates the downward rotation of the handle 170 around the width direction. The rotation stopper 56 is a first flat plate that is provided on the upper surface of the combs 54 and is retracted inward from the combs 54. The rotation stopper 57 is a second flat plate that is provided on the upper surface of the combs 156 and is retracted inward from the combs 156.

As described above, the position of the handle 170 is regulated when the mounting body is mounted in the device by the correlation between the rotation stopper 56 provided in the device-side fitting portion 55 and the rotation stopper 57 provided in the liquid container-side fitting portion 155. That is, in a state where the liquid container 100 is mounted in the liquid ejection device 10, the grip portion 171 of the handle 170 is held at a position separated from the bag-shaped member 110. Therefore, in the mounting state of the liquid container 100 in the liquid ejection device 10, the bag-shaped member 110 is not pressed by the handle 170. Therefore, the deterioration of the pressure state in the containing portion in the bag-shaped member 110 by a pressure that is received from the handle 170 is suppressed. In addition, in the state where the liquid container 100 is mounted in the liquid ejection device 10, the handle 170 does not protrude in the height direction of the case 61. Therefore, there is no case where the handle 170 is fixed higher than usual due to a backlash or the like generated during the mounting of the liquid container 100 in the liquid ejection device 10, and there is no case where the case 61 is caught in the liquid ejection device 10 at the time of pulling out the case 61 in the horizontal direction, which makes it difficult to remove the case 61.

Figure 5A:
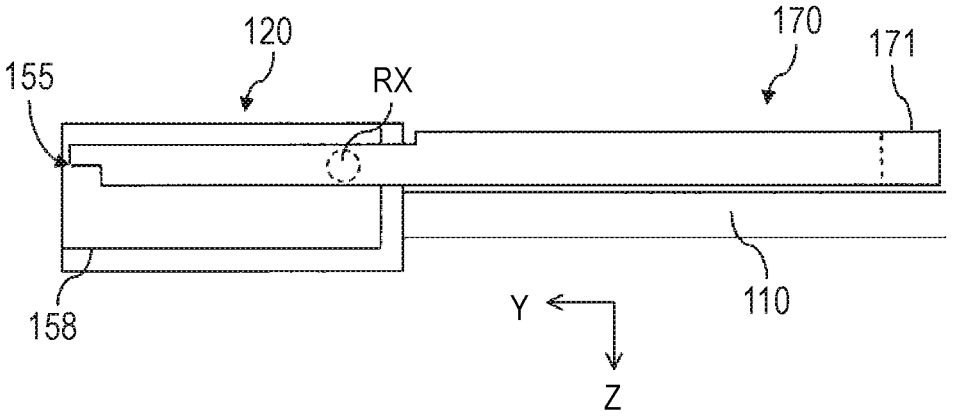
FIGS. 5A and 5B are side views for describing the rotation of a handle.
Figure 5B:
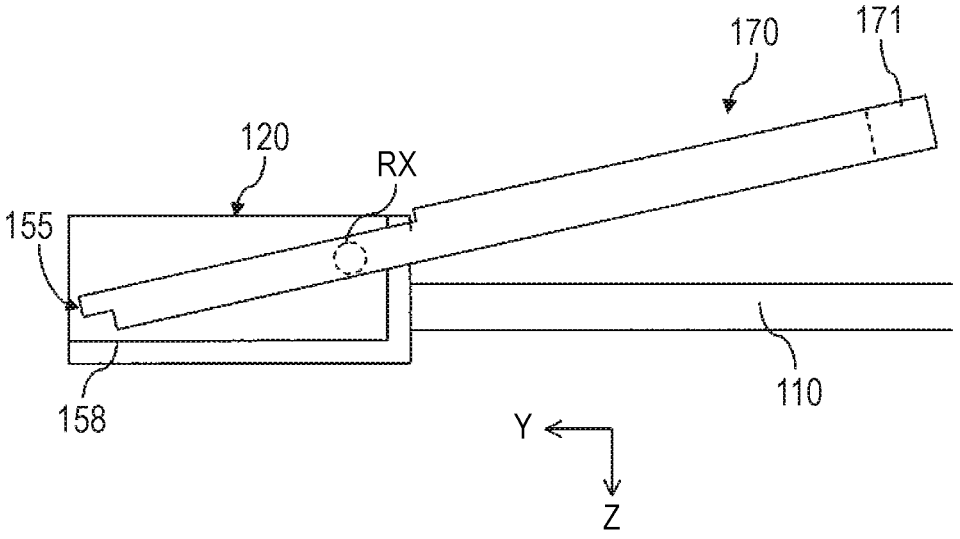

FIGS. 5A and 5B is a side view of the handle 170 for describing the rotation of the handle 170. The rotation range of the handle 170 in a direction separated from the bag-shaped member 110 is regulated by the liquid container-side fitting portion 155 and the rotation abutting surface 158. As illustrated in FIG. 5A, the rotation abutting surface 158 is provided in a direction opposite to the height direction of the connecting member 120 with respect to the liquid container-side fitting portion 155 in a mounted state. At the time of removing the liquid container 100 from the case 61, when the grip portion 171 of the handle 170 is lifted in the height direction of the connecting member 120, symmetrically with respect to the rotation axis RX, the liquid container-side fitting portion 155 descends in a direction opposite to the height direction of the connecting member 120. When the liquid container-side fitting portion 155 hits the rotation abutting surface 158, the rotation of the handle 170 is stopped, and the liquid container 100 can be removed from the case 61 by further lifting the grip portion 171 (FIG. 5B).

According to the present embodiment, in a state where the liquid container 100 is mounted in the liquid ejection device 10, when the liquid container-side fitting portion 155 that is integrated with the handle 170 is fitted to the device-side fitting portion 55 provided in the liquid ejection device 10, rotation around the rotation axis RX is suppressed. Therefore, the handle 170 is fixed at a certain position during the mounting of the liquid container 100 in the liquid ejection device 10. Therefore, one of the deterioration of the pressure state in the bag-shaped member, which is a bag-shaped member, and the generation of a disadvantage during removal can be suppressed as described above.

Second Embodiment

Figure 6A:
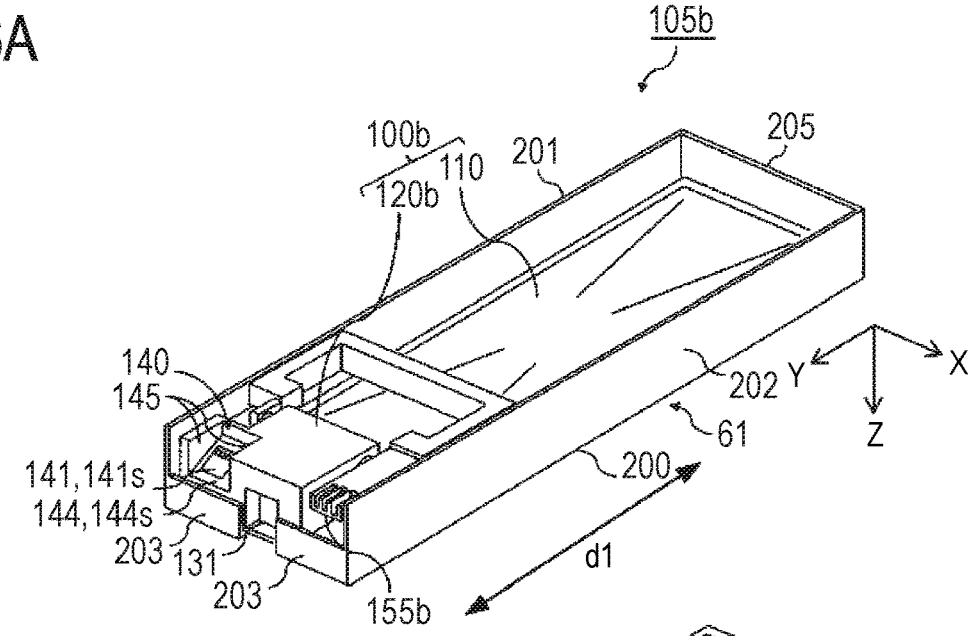
FIGS. 6A, 6B, and 6C are schematic perspective views of a liquid container in a second embodiment.
Figure 6B:
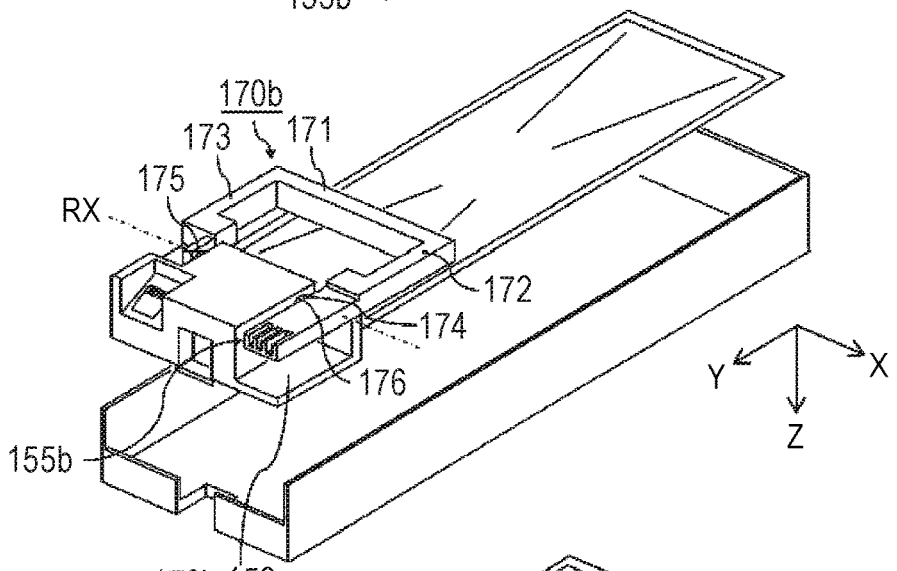
Figure 6C:
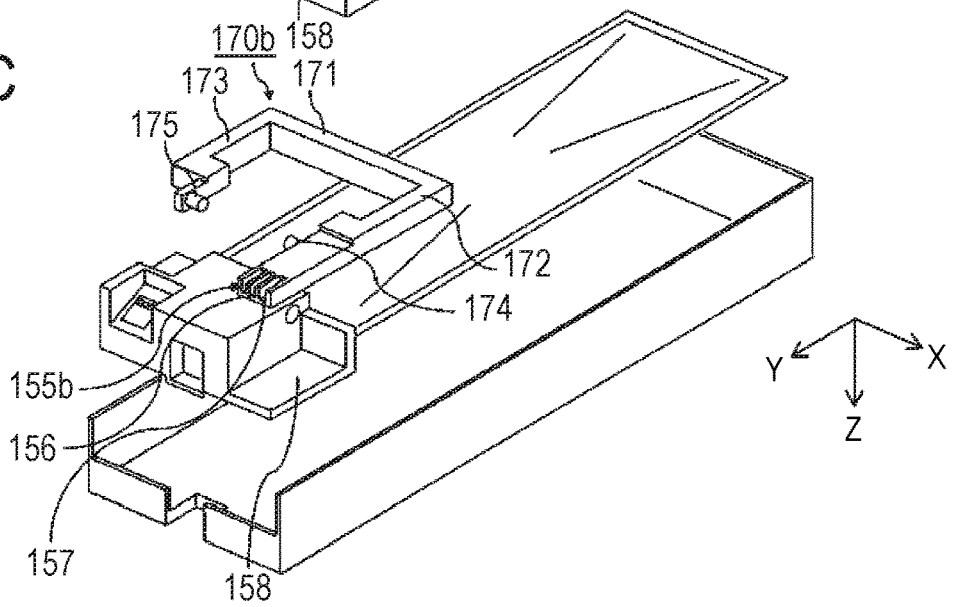

FIGS. 6A to 6C is a schematic perspective view of a liquid container 100*b* that is contained in a liquid ejection device in a second embodiment. FIG. 6A is a schematic perspective view of a mounting body in which the liquid container 100*b* in the second embodiment is contained. The state illustrated by FIG. 6A is a state of a mounting body 105*b* in which the liquid container 100*b* is housed in the case 61. The liquid container 100*b* is an ink pack and includes the bag-shaped member 110 and a connecting member 120*b*. FIG. 6B is a schematic perspective view illustrating the appearance of the liquid container 100*b* removed from the case 61. As illustrated in FIG. 6B, a handle 170*b* includes the grip portion 171, the two coupling portions 172 and 173, the two base end portions 174 and 175, and a liquid container-side fitting portion 155*b*. In the connecting member 120*b*, the structure of the liquid container-side fitting portion 155*b* that is provided in the connecting member 120*b* is different from the structure of the liquid container-side fitting portion 155 that is provided in the connecting member 120 in the first embodiment.

The liquid container-side fitting portion 155*b* is provided at an end portion of the handle 170*b* in a mounting direction of the mounting body 105*b*. FIG. 6C is a schematic perspective view illustrating the appearance of the handle 170*b* removed from the connecting member 120*b*. As illustrated in FIG. 6C, the position of the liquid container-side fitting portion 155*b* provided in the handle 170*b* is the same as the position of the liquid container-side fitting portion 155 provided in the first embodiment. Regarding the arrangement pattern of the protrusions and the recesses in the width direction in the combs 156 and the valley portions 157, which are formed between the combs 156, in the liquid container-side fitting portion 155*b*, the protrusions and the recesses are opposite to protrusions and recesses in the arrangement pattern in the protrusion and recess structure of a fitting portion inside the liquid ejection device 10 that is a connection target. The liquid ejection device 10 is provided with a plurality of connection receiving portions (slots) for the mounting of a plurality of the liquid containers 100*b*, and the connection receiving portion in which the liquid container 100*b* is mounted is determined depending on the color of ink that is contained in the liquid container 100*b*. In addition, similar to the first embodiment, the handle 170*b* is colored with the color of ink that is contained in the liquid container 100*b*, and furthermore, as the protrusion and recess structure of the liquid container-side fitting portion 155*b* of the liquid container 100*b*, a structure (shape) that corresponds to the protrusion and recess structure of the fitting portion of the connection receiving portion in which the liquid container 100*b* for the ink with the above-described color is to be contained is provided.

As described below, in the second embodiment, rotation stoppers 56*b* and 57*b* are configured to fully cover a device-side fitting portion 55*b* and the liquid container-side fitting portion 155*b*.

Figure 7A:
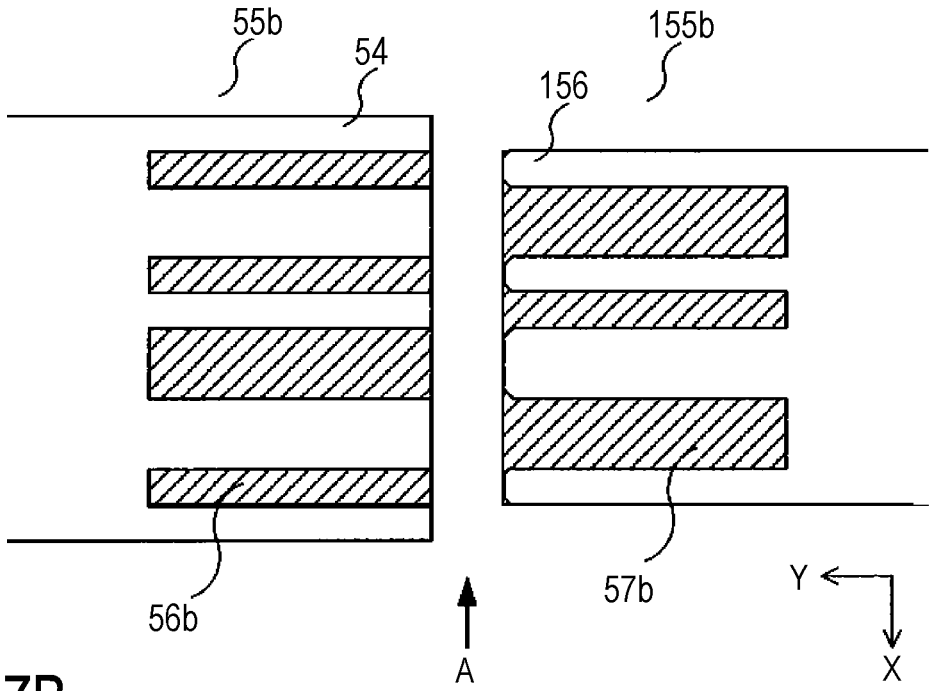
FIGS. 7A, 7B, and 7C are enlarged views of a first example of fitting portions in the second embodiment.
Figure 7B:
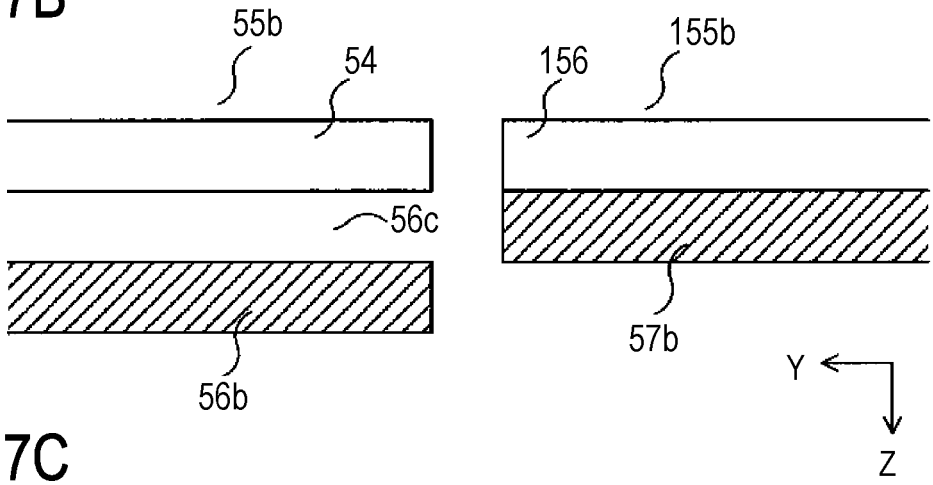
Figure 7C:
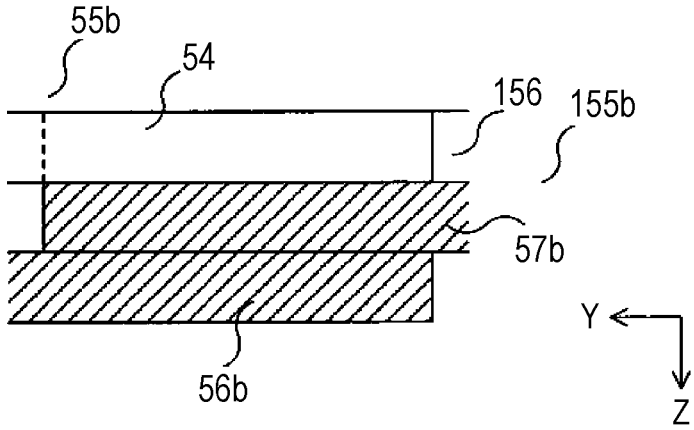

FIGS. 7A to 7C are enlarged views of a first example of the device-side fitting portion 55*b* inside the liquid ejection device 10 and the liquid container-side fitting portion 155*b* on the liquid container 100*b* side in the present embodiment. FIG. 7A is a top view, FIG. 7B is a side view of the structure of FIG. 7A seen in a direction A illustrated in FIG. 7A, and FIG. 7C is a side view of the structure of the device-side fitting portion 55*b* and the liquid container-side fitting portion 155*b* fitted to each other seen in the direction A illustrated in FIG. 7A. The structures and the arrangement patterns in the width direction of the respective combs 54 and combs 156 of the device-side fitting portion 55*b*, which is the first fitting portion, and the liquid container-side fitting portion 155*b*, which is the second fitting portion, are the same as those in the first embodiment. The liquid container-side fitting portion 155*b* is integrated with the handle 170*b* and rotates around the rotation axis RX in conjunction with the rotation of the handle 170*b* around the rotation axis RX (refer to FIGS. 5A and 5B). During the fitting of the device-side fitting portion 55*b* and the liquid container-side fitting portion 155*b*, in order to hinder the rotation of the liquid container-side fitting portion 155*b* around the rotation axis RX, as shown in FIG. 7B, in the device-side fitting portion 55*b* and the liquid container-side fitting portion 155*b*, rotation stoppers 56*b* and 57*b*, which are a first rotation regulating portion and a second rotation regulating portion, are provided, respectively, at the lower portions of the protrusion and recess structures and throughout the entire fitting portions. The rotation stopper 56*b* is a first flat plate that is provided in spaced apart relationship from the lower surfaces of the combs 54, thereby forming slot 56*c* between the rotation stopper 56*b* and the lower surfaces of the combs 54. The rotation stopper 57*b* can be inserted into the slot 56*c*. The rotation stopper 57*b* is a second flat plate that is provided on the lower surfaces of the combs 156. As illustrated in FIG. 7C, in a state where the liquid container 100*b* is mounted in the liquid ejection device 10 main body, the rotation stopper 56*b* abuts or faces the rotation stopper 57*b*, and the rotation stopper 57*b* abuts or faces the combs 54 and the rotation stopper 56*b*.

The rotation stoppers are configured throughout the entire fitting portions, whereby a stronger rotation-stopping effect can be exhibited than in the configuration of the rotation stoppers formed halfway as in the first embodiment. Reliability as a structure is enhanced by improving the structural strength.

Figure 8A:
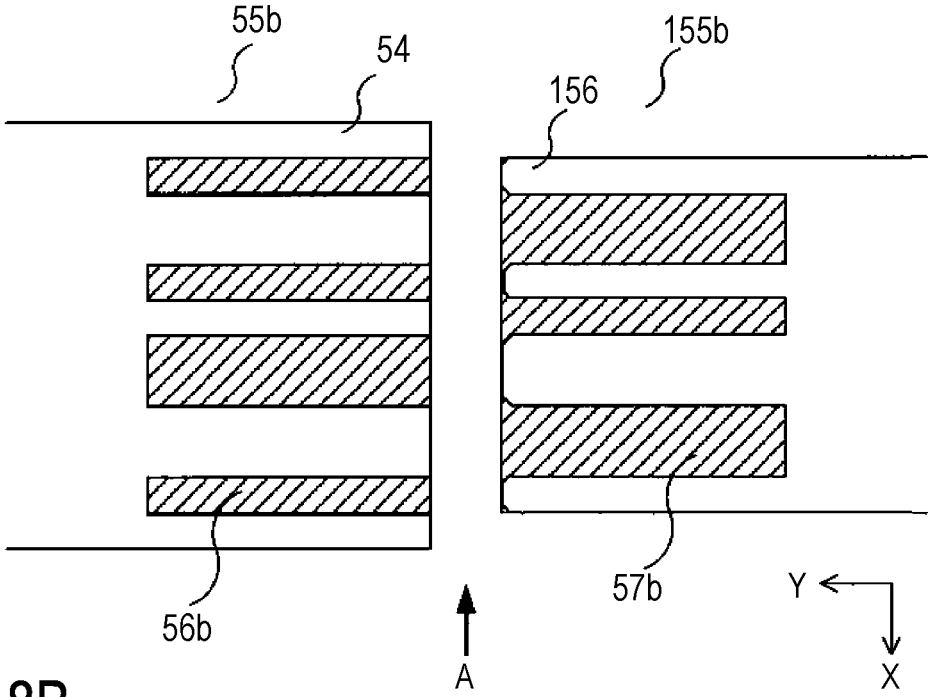
FIGS. 8A, 8B, and 8C are enlarged views of a second example of the fitting portions in the second embodiment.
Figure 8B:
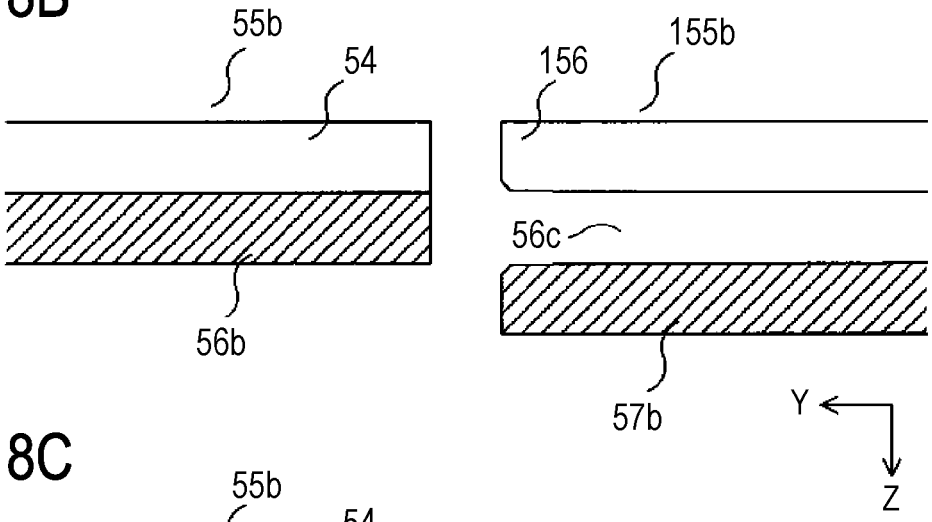
Figure 8C:
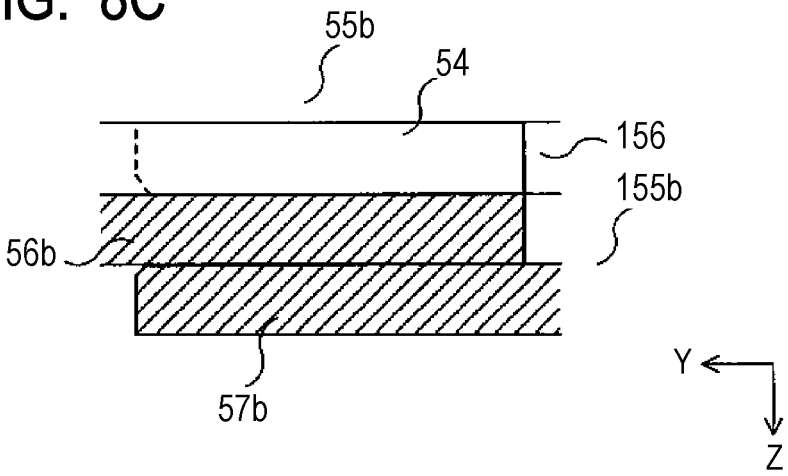

FIGS. 8A to 8C are enlarged views of a second example of the device-side fitting portion 55*b* inside the liquid ejection device 10 and the liquid container-side fitting portion 155*b* in the present embodiment. FIG. 8A is a top view, FIG. 8B is a side view of the structure of FIG. 8A seen in a direction A illustrated in FIG. 8A, and FIG. 8C is a side view of the structure of the device-side fitting portion 55*b* and the liquid container-side fitting portion 155*b* fitted to each other seen in the direction A illustrated in FIG. 8A. The structures and the arrangement patterns in the width direction of the respective combs 54 and combs 156 of the device-side fitting portion 55*b*, which is the first fitting portion, and the liquid container-side fitting portion 155*b*, which is the second fitting portion, are the same as those in the first embodiment. The liquid container-side fitting portion 155*b* is integrated with the handle 170*b* and rotates around the rotation axis RX in conjunction with the rotation of the handle 170*b* around the rotation axis RX (refer to FIGS. 5A and 5B). During the fitting of the device-side fitting portion 55*b* and the liquid container-side fitting portion 155*b*, in order to hinder the rotation of the liquid container-side fitting portion 155*b* around the rotation axis RX, as shown in FIG. 8B, in the device-side fitting portion 55*b* and the liquid container-side fitting portion 155*b*, rotation stoppers 56*b* and 57*b*, which are a first rotation regulating portion and a second rotation regulating portion, are provided, respectively, at the lower portions of the protrusion and recess structures. The rotation stopper 56*b* is a first flat plate that is provided on the lower surfaces of the combs 54. The rotation stopper 57*b* is a second flat plate that is provided in spaced apart relationship from the lower surfaces of the combs 156, thereby forming slot 56*c* between the lower surfaces of the combs 156 and the rotation stopper 57*b*. The rotation stopper 56*b* can be inserted into the slot 56*c*. In this structure, the configuration of the rotation stoppers 56*b* and 57*b* is opposite to the configuration illustrated in FIG. 7B. As illustrated in FIG. 8C, in a state where the liquid container 100*b* is mounted in the liquid ejection device 10 main body, the rotation stopper 56*b* abuts or faces the combs 156 and the rotation stopper 57*b*, and the rotation stopper 57*b* abuts or faces the rotation stopper 56*b*.

Figure 9A:
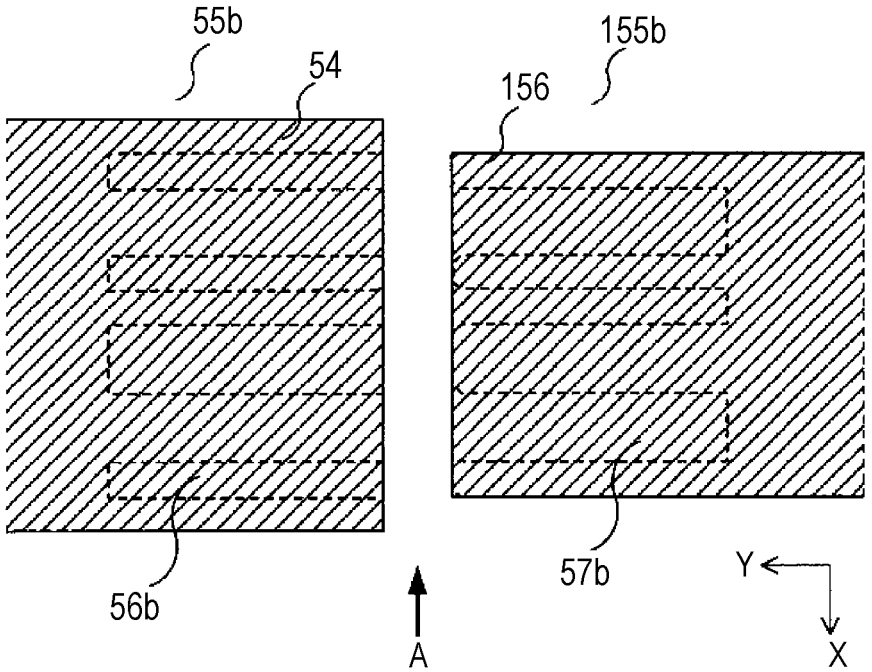
FIGS. 9A, 9B, and 9C are enlarged views of a third example of the fitting portions in the second embodiment.
Figure 9B:
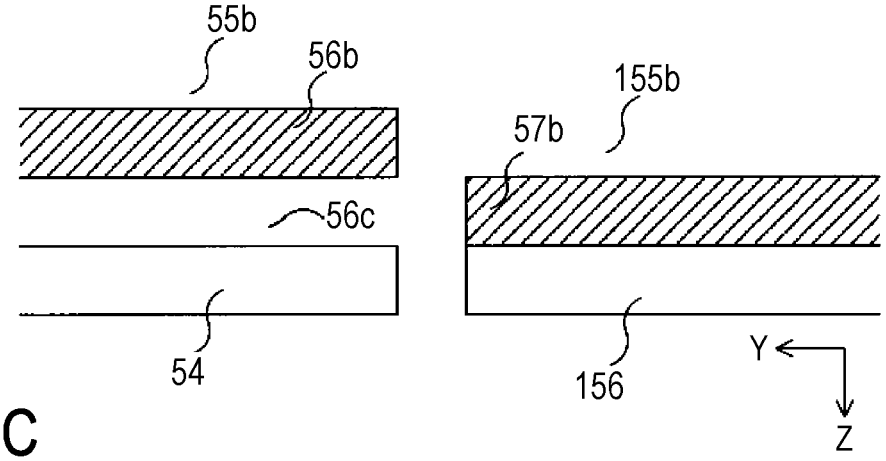
Figure 9C:
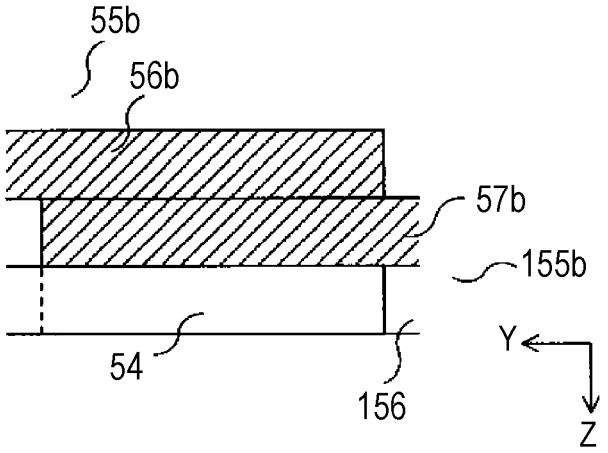

FIGS. 9A to 9C are enlarged views of a third example of the device-side fitting portion 55*b* inside the liquid ejection device 10 and the liquid container-side fitting portion 155*b* in the present embodiment. FIG. 9A is a top view, FIG. 9B is a side view of the structure of FIG. 9A seen in a direction A illustrated in FIG. 9A, and FIG. 9C is a side view of the structure of the device-side fitting portion 55*b* and the liquid container-side fitting portion 155*b* fitted to each other seen in the direction A illustrated in FIG. 9A. Due to the disposition of the rotation stopper 56*b* and the rotation stopper 57*b*, the combs 54 and the combs 156 are not visible from above the device-side fitting portion 55*b* and the liquid container-side fitting portion 155*b*, respectively, and are thus indicated by broken lines in FIG. 9A. The structures and the arrangement patterns in the width direction of the respective combs 54 and combs 156 of the device-side fitting portion 55*b*, which is the first fitting portion, and the liquid container-side fitting portion 155*b*, which is the second fitting portion, are the same as those in the first embodiment. The liquid container-side fitting portion 155*b* is integrated with the handle 170*b* and rotates around the rotation axis RX in conjunction with the rotation of the handle 170*b* around the rotation axis RX (refer to FIGS. 5A and 5B). During the fitting of the device-side fitting portion 55*b* and the liquid container-side fitting portion 155*b*, in order to hinder the rotation of the liquid container-side fitting portion 155*b* around the rotation axis RX, in the device-side fitting portion 55*b* and the liquid container-side fitting portion 155*b*, rotation stoppers 56*b* and 57*b*, which are a first rotation regulating portion and a second rotation regulating portion, are provided, respectively, at the upper portions of the protrusion and recess structures. The rotation stopper 56*b* is a first flat plate that is provided in spaced apart relationship from the upper surfaces of the combs 54, thereby forming slot 56*c* between the rotation stopper 56*b* and the upper surfaces of the combs 54. The rotation stopper 57*b* can be inserted into the slot 56*c*. The rotation stopper 57*b* is a second flat plate that is provided on the upper surfaces of the combs 156 and throughout the entire fitting portion. As illustrated in FIG. 9C, in a state where the liquid container 100*b* is mounted in the liquid ejection device 10 main body, the rotation stopper 56*b* abuts or faces the rotation stopper 57*b*, and the rotation stopper 57*b* abuts or faces the combs 54 and the rotation stopper 56*b*.

Figure 10A:
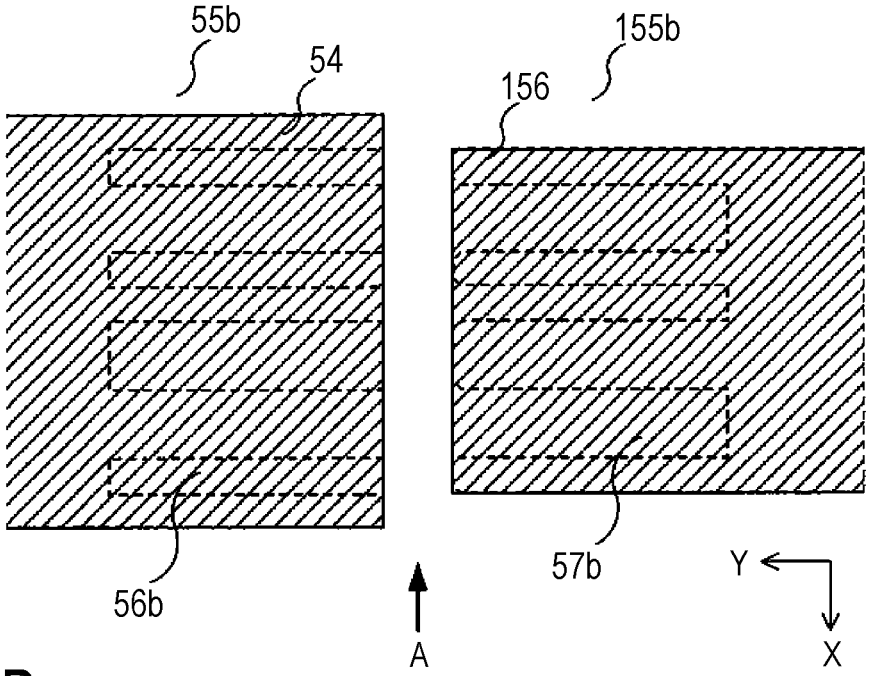
FIGS. 10A, 10B, and 10C are enlarged views of a fourth example of the fitting portions in the second embodiment.
Figure 10B:
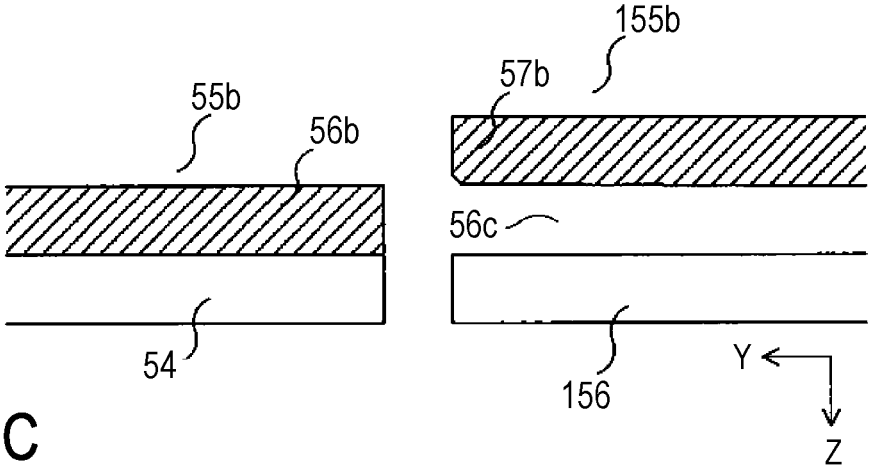
Figure 10C:
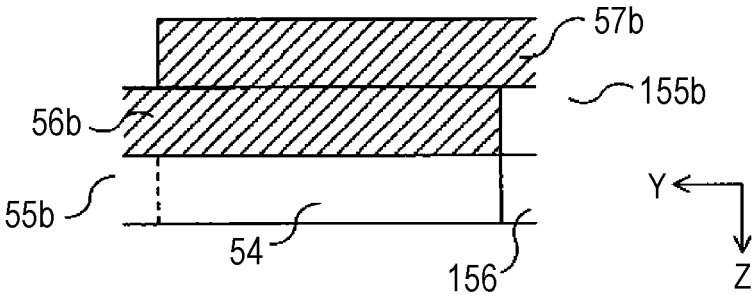

FIGS. 10A to 10C are enlarged views of a fourth example of the device-side fitting portion 55*b* inside the liquid ejection device 10 and the liquid container-side fitting portion 155*b* in the present embodiment. FIG. 10A is a top view, FIG. 10B is a side view of the structure of FIG. 10A seen in a direction A illustrated in FIG. 10A, and FIG. 10C is a side view of the structure of the device-side fitting portion 55*b* and the liquid container-side fitting portion 155*b* fitted to each other seen in the direction A illustrated in FIG. 10A. Due to the disposition of the rotation stopper 56*b* and the rotation stopper 57*b*, the combs 54 and the combs 156 are not visible from above the device-side fitting portion 55*b* and the liquid container-side fitting portion 155*b*, respectively, and are thus indicated by broken lines in FIG. 10A. The structures and the arrangement patterns in the width direction of the respective combs 54 and combs 156 of the device-side fitting portion 55*b*, which is the first fitting portion, and the liquid container-side fitting portion 155*b*, which is the second fitting portion, are the same as those in the first embodiment. The liquid container-side fitting portion 155*b* is integrated with the handle 170*b* and rotates around the rotation axis RX in conjunction with the rotation of the handle 170*b* around the rotation axis RX (refer to FIGS. 5A and 5B). During the fitting of the device-side fitting portion 55*b* and the liquid container-side fitting portion 155*b*, in order to hinder the rotation of the liquid container-side fitting portion 155*b* around the rotation axis RX, in the device-side fitting portion 55*b* and the liquid container-side fitting portion 155*b*, rotation stoppers 56*b* and 57*b*, which are a first rotation regulating portion and a second rotation regulating portion, are provided, respectively, at the upper portions of the protrusion and recess structures. The rotation stopper 56*b* is a first flat plate that is provided on the upper surfaces of the combs 54. The rotation stopper 57*b* is a second flat plate that is provided in spaced apart relationship from the upper surfaces of the combs 156, thereby forming slot 56*c* between the upper surfaces of the combs 156 and the rotation stopper 57*b*. The rotation stopper 56*b* can be inserted into the slot 56*c*. The configuration of the rotation stopper 57*b* is opposite to the configuration in FIG. 9B. As illustrated in FIG. 10C, in a state where the liquid container 100*b* is mounted in the liquid ejection device 10 main body, the rotation stopper 56*b* abuts or faces the combs 156 and the rotation stopper 57*b*, and the rotation stopper 57*b* abuts or faces the rotation stopper 56*b*.

According to the present embodiment, in a state where the liquid container 100*b* is mounted in the liquid ejection device 10, when the liquid container-side fitting portion 155*b* that is integrated with the handle 170*b* is fitted to the device-side fitting portion 55*b* provided in the liquid ejection device 10, rotation around the rotation axis RX is suppressed. Therefore, the handle 170*b* is fixed at a certain position during the mounting of the liquid container 100*b* in the liquid ejection device 10. Therefore, one of the deterioration of the pressure state of the bag-shaped member as described above and the generation of a disadvantage during removal can be suppressed.

In addition, the rotation stoppers are configured throughout the entire fitting portions, whereby a stronger rotation-stopping effect can be exhibited than in the configuration of the rotation stoppers formed halfway as in the first embodiment. Reliability as a structure is enhanced by improving the structural strength.

Third Embodiment

Figure 11:
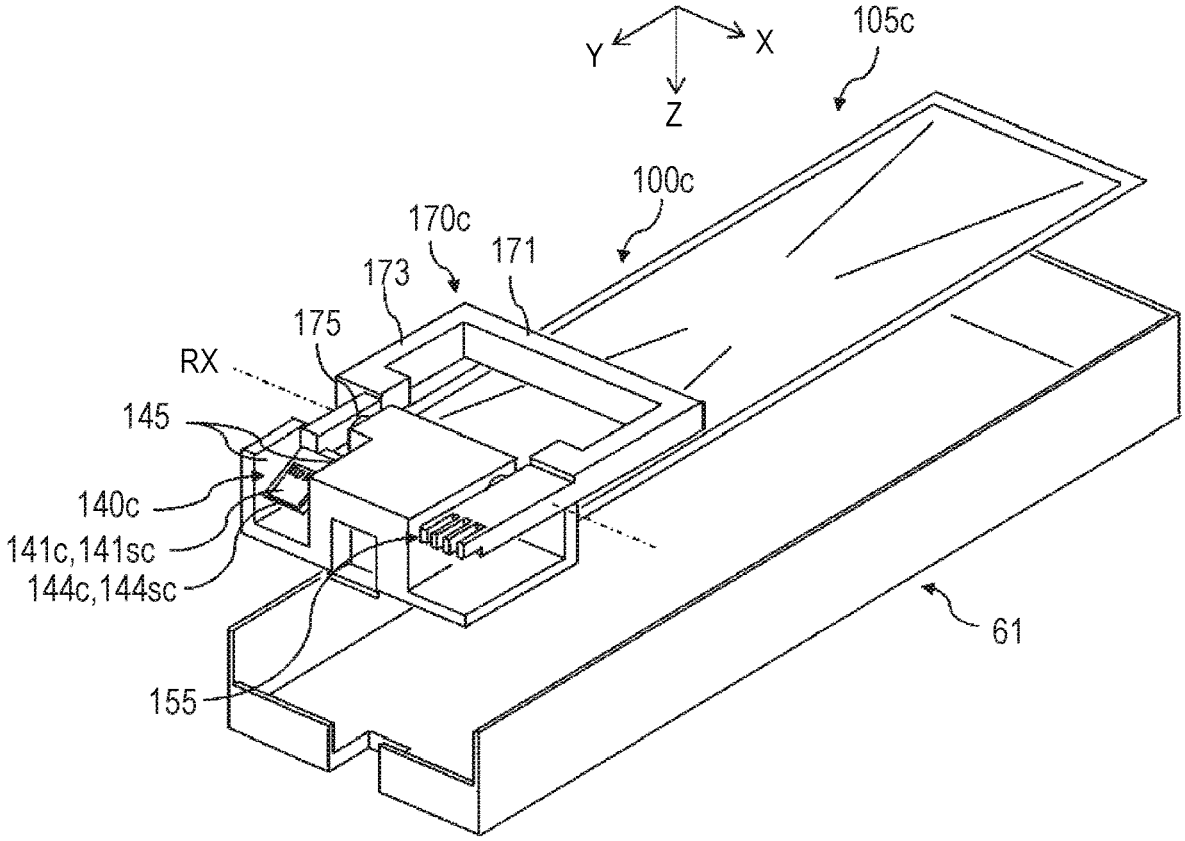
FIG. 11 is a schematic perspective view of a liquid container in a third embodiment.

The electrical connecting portion may be integrated with the handle. FIG. 11 is a schematic perspective view of a mounting body 105*c* when a liquid container 100*c* is removed from the case 61 in a third embodiment. The third embodiment is an aspect in which an electrical connecting portion is provided in the handle of the first embodiment. The mounting body 105*c* is made up of the liquid container 100*c* and the case 61. A handle 170*c* in the liquid container 100*c* has the liquid container-side fitting portion 155 and an electrical connecting portion 140*c*. The electrical connecting portion 140*c* is provided at an end portion of the handle 170*c* in a mounting direction of the mounting body 105*c*. The electrical connecting portion 140*c* is provided on an extension line from the coupling portion 173 of the handle 170*c* and at a position opposite to the grip portion 171 across the base end portion 175. The electrical connecting portion 140*c* includes a substrate 141*c* configured to be connected to a device-side electrical connecting portion. A plurality of terminals is disposed on a surface 141*sc* of the substrate 141*c*. The plurality of terminals is disposed at positions corresponding to terminals in the device-side electrical connecting portion. On a surface opposite to the surface 141*sc* of the substrate 141*c*, a storage device that stores information regarding the liquid, a circuit for detecting the connection of the device-side electrical connecting portion, or the like may be provided. To a substrate disposition portion 144*c* in which the substrate 141*c* is disposed, an inclined surface 144*sc* that faces in a direction inclined upward between the longitudinal direction and the height direction is fixed by a processing method such as heat swaging. The electrical connecting portion 140*c* is disposed to be inclined on the inclined surface 144*sc* at a disposition angle that is almost parallel to the inclined surface 144*sc*. That is, the normal vector of a contact surface of the surface 141*sc* of the substrate 141*c* has a vector component in the longitudinal direction and a vector component in the height direction. The substrate 141*c* in a mounted state is installed at a deep position in the substrate disposition portion 144*c*. The substrate 141*c* is sandwiched by two wall portions 145 that protrude in the longitudinal direction and in the height direction from the surface 141*sc* of the substrate 141*c* on both sides in the width direction. In the present embodiment, when the grip portion 171 of the handle 170*c* is lifted in the height direction, symmetrically with respect to the rotation axis RX, the electrical connecting portion 140*c* descends in a direction opposite to the height direction. This rotation moves the electrical connecting portion 140*c* deeper into a portion between the wall portions 145, which enables the prevention of the electrical connecting portion 140*c* being damaged by the user's accidental touching of the substrate 141*c* at the time of removing the liquid container 100*c*. In addition, in the present embodiment, the structure of the liquid container-side fitting portion 155 adopts the same configuration as the configuration described in Example 1. The liquid container-side fitting portion 155 is fitted to the fitting portion in the liquid ejection device 10, whereby the handle 170*c* is also fixed at a certain position. Therefore, the position of the electrical connecting portion 140*c* also becomes constant in the mounted state, and poor contact with a device-side electrical connecting portion is suppressed.

In a case where the electrical connecting portion is provided in the handle as described above, the structure of the liquid container-side fitting portion 155 provided to suppress unnecessary turning of the handle can also be used as a positioning structure of the electrical connecting portion.

Fourth Embodiment

Figure 12:
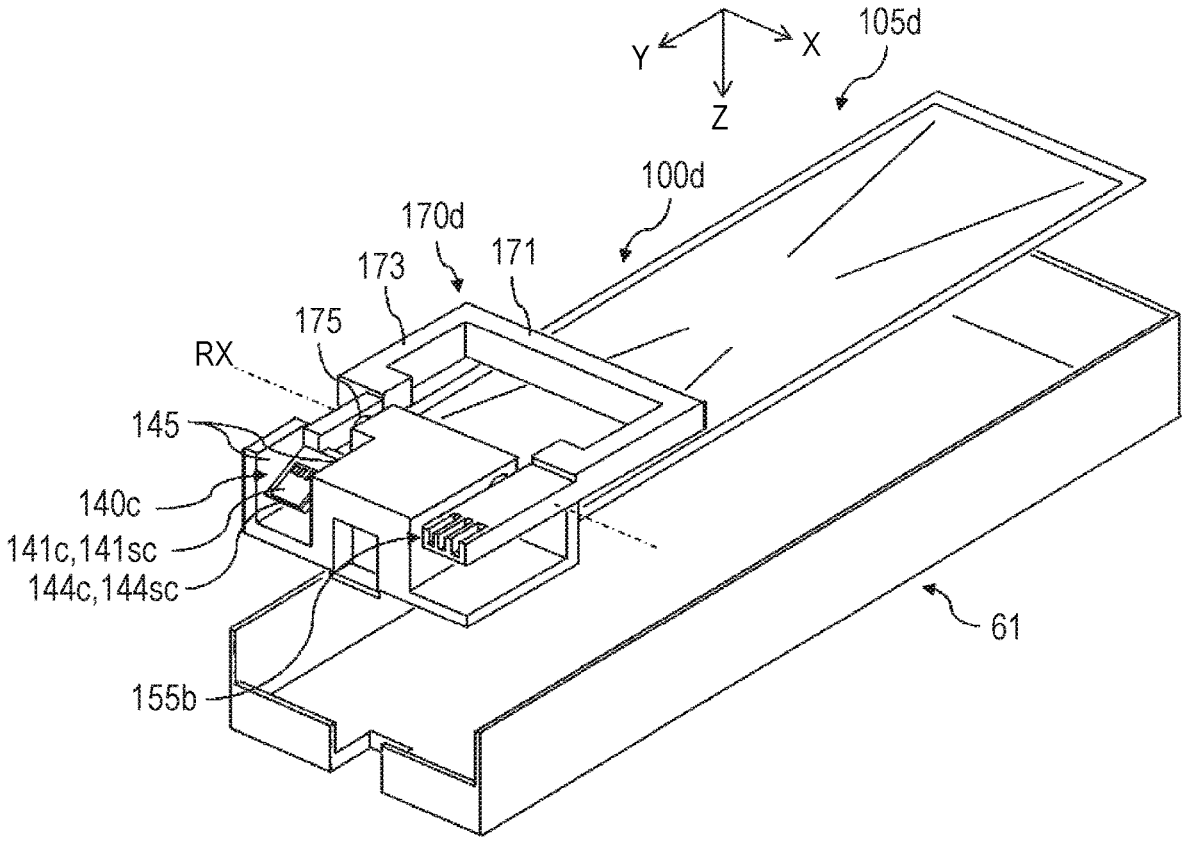
FIG. 12 is a schematic perspective view of a liquid container in a fourth embodiment.

FIG. 12 is a schematic perspective view of a mounting body 105*d* when a liquid container 100*d* is removed from the case 61 in a fourth embodiment. The fourth embodiment is an aspect in which an electrical connecting portion is provided in the handle of the second embodiment. The mounting body 105*d* is made up of the liquid container 100*d* and the case 61. A handle 170*d* in the liquid container 100*d* has the liquid container side fitting portion 155*b* and the electrical connecting portion 140*c*. The electrical connecting portion 140*c* is provided at an end portion of the handle 170*d* in a mounting direction of the mounting body 105*d*. The electrical connecting portion 140*c* is provided on an extension line from the coupling portion 173 of the handle 170*d* and at a position opposite to the grip portion 171 across the base end portion 175. The electrical connecting portion 140*c* includes a substrate 141*c* configured to be connected to a device-side electrical connecting portion. A plurality of terminals is disposed on a surface 141*sc* of the substrate 141*c*. The plurality of terminals is disposed at positions corresponding to terminals in the device-side electrical connecting portion. On a surface opposite to the surface 141*sc* of the substrate 141*c*, a storage device that stores information regarding the liquid, a circuit for detecting the connection of the device-side electrical connecting portion, or the like may be provided. To a substrate disposition portion 144*c* in which the substrate 141*c* is disposed, an inclined surface 144*sc* that faces in a direction inclined upward between the longitudinal direction and the height direction is fixed by a processing method such as heat swaging. The electrical connecting portion 140*c* is disposed to be inclined on the inclined surface 144*sc* at a disposition angle that is almost parallel to the inclined surface 144*sc*. That is, the normal vector of a contact surface of the surface 141*sc* of the substrate 141*c* has a vector component in the longitudinal direction and a vector component in the height direction. The substrate 141*c* in a mounted state is installed at a deep position in the substrate disposition portion 144*c*. The substrate 141*c* is sandwiched by two wall portions 145 that protrude in the longitudinal direction and in the height direction from the surface 141*sc* of the substrate 141*c* on both sides in the width direction. In the present embodiment, when the grip portion 171 of the handle 170*d* is lifted in the height direction, symmetrically with respect to the rotation axis RX, the electrical connecting portion 140*c* descends in a direction opposite to the height direction. This rotation moves the electrical connecting portion 140*c* deeper into a portion between the wall portions 145, which enables the prevention of the electrical connecting portion 140*c* being damaged by the user's accidental touching of the substrate 141*c* at the time of removing the liquid container 100*d*. In addition, in the present embodiment, the structure of the liquid container-side fitting portion 155*b* adopts the same configuration as the configuration described in the second embodiment. The liquid container-side fitting portion 155*b* is fitted to the fitting portion in the liquid ejection device 10, whereby the handle 170*d* is also fixed at a certain position. Therefore, the position of the electrical connecting portion 140*c* also becomes constant in the mounted state, and poor contact with a device-side electrical connecting portion is suppressed.

In a case where the electrical connecting portion is provided in the handle as described above, the structure of the liquid container-side fitting portion 155 provided to suppress unnecessary turning of the handle can also be used as a positioning structure of the electrical connecting portion.

It should be noted that the second fitting portion and the electrical connecting portion need to be provided on both sides of the liquid withdrawal port, respectively, and which one needs to be on the right side of the liquid withdrawal port and which one needs to be on the left side of the liquid withdrawal port is not limited. However, it is needless to say that the respective positions of the second fitting portion and the electrical connecting portion are positions corresponding to the respective positions of the fitting portion inside the liquid container and the device-side electrical connecting portion.

According to the present invention, the position of the handle can be maintained at a predetermined position in a state where the liquid container is mounted in the liquid ejection device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-030487, filed Feb. 26, 2020, and Japanese Patent Application No. 2020-186971, filed Nov. 10, 2020 which are hereby incorporated by reference herein in their entirety.

What is claimed is:

1. A liquid ejection device comprising:

a device main body that ejections a liquid; and a liquid container that is attachable to and detachable from the device main body and contains the liquid, wherein the device main body has a first fitting portion, the liquid container has a handle that rotates around an axis that intersects with an attachment and detachment direction of the liquid container, and the handle has a second fitting portion that fits to the first fitting portion, wherein the first fitting portion and the second fitting portion have a first rotation regulating portion and a second rotation regulating portion that regulate the rotation of the handle with respect to the device main body, respectively.

2. The liquid ejection device according to claim 1, wherein the first rotation regulating portion has a first comb having a plurality of plate materials arranged in a width direction and a first flat plate that is provided on a lower surface of the first comb and is retracted inward from the first comb, the second rotation regulating portion has a second comb having a plurality of plate materials arranged in the width direction, and in a state where the liquid container is mounted in the device main body, the second comb fits to the first comb and abuts or faces the first flat plate.

3. The liquid ejection device according to claim 2, wherein the second rotation regulating portion has a second flat plate that is provided on a lower surface of the second comb and is retracted inward from the second comb, and in a state where the liquid container is mounted in the device main body, the first comb abuts or faces the second flat plate.

4. The liquid ejection device according to claim 1, wherein the first rotation regulating portion has a first comb having a plurality of plate materials arranged in a width direction, the second rotation regulating portion has a second comb having a plurality of plate materials arranged in the width direction and a second flat plate that is provided on an upper surface of the second comb and is retracted inward from the second comb, and in a state where the liquid container is mounted in the device main body, the first comb fits to the second comb and abuts or faces the second flat plate.

5. The liquid ejection device according to claim 4, wherein the first rotation regulating portion has a first flat plate that is provided on an upper surface of the first comb and is retracted inward from the first comb, and, in a state where the liquid container is mounted in the device main body, the second comb abuts or faces the first flat plate.

6. The liquid ejection device according to claim 1, wherein the first rotation regulating portion has a first comb having a plurality of plate materials arranged in a width direction and a first flat plate that is provided below the first comb with a slot formed therebetween, the second rotation regulating portion has a second comb having a plurality of plate materials arranged in the width direction and a second flat plate that is provided on a lower surface of the second comb, and in a state where the liquid container is mounted in the device main body, the second comb fits to the first comb, and the second flat plate is inserted into the slot.

7. The liquid ejection device according to claim 1, wherein the first rotation regulating portion has a first comb having a plurality of plate materials arranged in a width direction and a first flat plate that is provided on a lower surface of the first comb, the second rotation regulating portion has a second comb having a plurality of plate materials arranged in the width direction and a second flat plate that is provided below the second comb with a slot formed therebetween, and in a state where the liquid container is mounted in the device main body, the second comb fits to the first comb, and the first flat plate is inserted into the slot.

8. The liquid ejection device according to claim 1, wherein the first rotation regulating portion has a first comb having a plurality of plate materials arranged in a width direction and a first flat plate that is provided above the first comb with a slot formed therebetween, the second rotation regulating portion has a second comb having a plurality of plate materials arranged in the width direction and a second flat plate that is provided on an upper surface of the second comb, and in a state where the liquid container is mounted in the device main body, the second comb fits to the first comb, and the second flat plate is inserted into the slot.

9. The liquid ejection device according to claim 1, wherein the first rotation regulating portion has a first comb having a plurality of plate materials arranged in a width direction and a first flat plate that is provided on an upper surface of the first comb, the second rotation regulating portion has a second comb having a plurality of plate materials arranged in the width direction and a second flat plate that is provided above the second comb with a slot formed therebetween, and in a state where the liquid container is mounted in the device main body, the second comb fits to the first comb, and the first flat plate is inserted into the slot.

10. The liquid ejection device according to claim 1, wherein a plurality of the liquid containers is provided, and a combination between a shape of the first fitting portion and a shape of the second fitting portion is different for each liquid container.

11. The liquid ejection device according to claim 10, wherein the plurality of liquid containers contains liquids having mutually different colors.

12. The liquid ejection device according to claim 1, wherein the handle has an electrical connecting portion that electrically connects the device main body and a connecting member that connects the liquid container to the device main body in a state where the liquid container is mounted in the device main body.

13. A liquid container that is attachable to and detachable from a device main body ejecting a liquid and contains the liquid, the liquid container comprising:

a handle that rotates around an axis that extends in a width direction, wherein the handle has a second fitting portion that fits to a first fitting portion provided in the device main body, wherein the second fitting portion has a rotation regulating portion that regulates the rotation of the handle with respect to the device main body.

14. The liquid container according to claim 13, wherein the handle has an electrical connecting portion that electrically connects the device main body and a connecting member that connects the liquid container to the device main body in a state where the liquid container is mounted in the device main body.

* * * * *